United States Patent [19]

Wolk et al.

[11] 3,948,756

[45] Apr. 6, 1976

[54] PENTANE INSOLUBLE ASPHALTENE REMOVAL

[75] Inventors: Ronald H. Wolk, Trenton, N.J.; Govanon Nongbri, Newtown, Pa.; Seymour B. Alpert, Princeton, N.J.

[73] Assignee: Hydrocarbon Research, Inc., Morristown, N.J.

[22] Filed: Sept. 13, 1973

[21] Appl. No.: 397,070

Related U.S. Application Data

[63] Continuation of Ser. No. 173,209, Aug. 19, 1971, abandoned.

[52] U.S. Cl. ..... 208/57; 208/110; 208/112; 208/158; 208/264

[51] Int. Cl.[2] ..... C10G 34/06

[58] Field of Search ..... 208/108, 57, 58, 59, 112

[56] References Cited

UNITED STATES PATENTS

| | | | |
|---|---|---|---|
| 2,768,936 | 10/1956 | Anderson et al. | 208/108 |
| 2,950,242 | 8/1960 | Thorpe et al. | 208/108 |
| 3,068,168 | 12/1962 | Anderson et al. | 208/108 |
| 3,183,179 | 5/1965 | Schuman | 208/97 |
| 3,429,801 | 2/1969 | Gleim et al. | 208/58 |
| 3,622,499 | 11/1971 | Stine et al. | 208/108 |

*Primary Examiner*—Delbert E. Gantz
*Assistant Examiner*—G. E. Schmitkons

[57] ABSTRACT

The maximum conversion and desulfurization of residual petroleum oils having a high content of asphaltenes can be attained by first converting a maximum amount of the asphaltenes contained in these feeds by pretreating the feeds with hydrogen under a selected combination of operating conditions. Conditions of temperature between 700° and 800°F, liquid space velocity between 0.1 and 2.0 $V_f/hr/V_r$ and hydrogen partial pressure between 1200 and 3000 psig, result in a maximum conversion of asphaltenes when 5 to 45 volume percent of the 975°F+ fraction in the feedstock is converted to lower boiling fractions.

5 Claims, 4 Drawing Figures

INVENTORS
RONALD H. WOLK
GOVANON NONGBRI
SEYMOUR B. ALPERT
by
ATTORNEY

PENTANE INSOLUBLE ASPHALTENE REMOVAL

RELATED APPLICATION

This is a continuation of application Ser. No. 173,209, filed Aug. 19, 1971, now abandoned.

BACKGROUND

When subjected to normal catalytic hydrogenation processes, residual petroleum oils cause rapid catalyst deactivation. This is due for the most part to the presence of the large quantities of pentane insoluble asphaltenes in the residual petroleum oils.

The term "pentane insoluble asphaltenes" hereinafter called asphaltenes is herein used to mean the pentane insoluble high boiling asphaltenes that are sheet-like structured materials containing the bulk of the metal components in the oil. The asphaltenes are readily adsorbed on the surface of the catalysts and the metals, such as vanadium and nickel, which primarily associated with the asphaltenes, are deposited on the catalyst particles thus blocking the catalyst pores and preventing other molecules from coming into contact with the active catalyst sites. Asphaltenes are responsible for the rapid deactivation that is usually observed in residual oil hydrodesulfurization. Furthermore at high temperatures, the asphaltene molecules polymerize and cause plugging of the catalyst bed in high conversion operations.

In order to avoid this rapid catalyst deactivation due to the asphaltenes, it is a practice in the prior art to only treat a portion of the resid feed. The vacuum gas oil is separated by distillation, hydrotreated and then blended back with the residual oil material. This prevents the contacting of the catalyst with asphaltenes. A major problem arises under the foregoing method when the production of a low sulfur fuel is desired, since the sulfur contained in the asphaltene molecules represents a significant portion of the total sulfur and has not been removed.

It has therefore become necessary to discover a method which will economically hydrotreat asphaltene containing residual oil feedstocks without rapid deactivation of the catalysts employed.

SUMMARY

The process encompassed by the present invention is particularly directed toward the maximum conversion of the asphaltenes in a resid feedstock before further treating wherein the feestock is exposed to a catalyst that would be rapidly deactivated by the asphaltenes. It was discovered in this invention that an asphaltene containing residual oil feedstock could most effectively be desulfurized or upgraded if it was first subjected to a mild hydrogenation. For the purpose of this invention "mild hydrogenation" means temperatures between 700°F and 800°F, hydrogen partial pressures between 1200 and 3000 psig and liquid space velocities between 0.1 and 2.0 $V_f/hr/V_r$. More particularly, in this invention it was discovered that a residual oil would undergo a 5 to 45 percent conversion of the 975°F plus fraction in the resid to lower boiling fractions when subjected to mild hydrogenation. This was significant as it was discovered that this resulted in a conversion of a maximum of the asphaltenes in the residual oil thereby assuring the maximum prolonged activity of the final desulfurization catalyst.

Asphaltene removal is a function of the conversion of the 975°F plus material in the feed and goes through a maximum at certain conversion levels, which were discovered to be about 5 to 45 volume percent conversion with the preferred range lying between 10 and 30 percent conversion.

The maximum removal of asphaltenes that can be obtained for different residual oil feeds and different catalysts is different and occurs at different conversion levels.

In this process the residual oil is fed together with hydrogen upwardly through an ebullated bed reaction zone. The operating concepts of the ebullated bed are set forth in U.S. Pat. No. Re. 25,770. The reaction zone can be a single reactor or a series of reactors. It is preferable that the mild hydrogenation takes place at temperatures between 720°F and 780°F, hydrogen partial pressures between 1500 and 2400 psig and liquid space velocities between 0.3 and 1.0 $V_f/hr/V_r$.

The liquid effluent from the mild hydrogenation reactor or series of reactors would either then be flashed by atmospheric distillation and the long resid desulfurized in another reactor or series of reactors, or flashed by atmospheric distillation and deep vacuum distillation and then finally deasphalted. This deasphalting could utilize any solvent ($C_3$, $C_4$, $C_5$, etc.) depending on the degree of reduction desired. The heavy gas oils, obtained from both deep vacuum distillation and deasphalting, may then be sent to a second reactor system. In this second system the conditions will be set either to convert the heavy gas oil material into light fractions or alternatively the collected heavy gas could be desulfurized in the second reactor to yield a low sulfur gas oil. This low sulfur gas oil could then be blended back with the nondistillable residuum or asphalt to yield a low sulfur fuel oil.

DESCRIPTION OF THE PREFERRED EMBODIMENT

Figure 1:
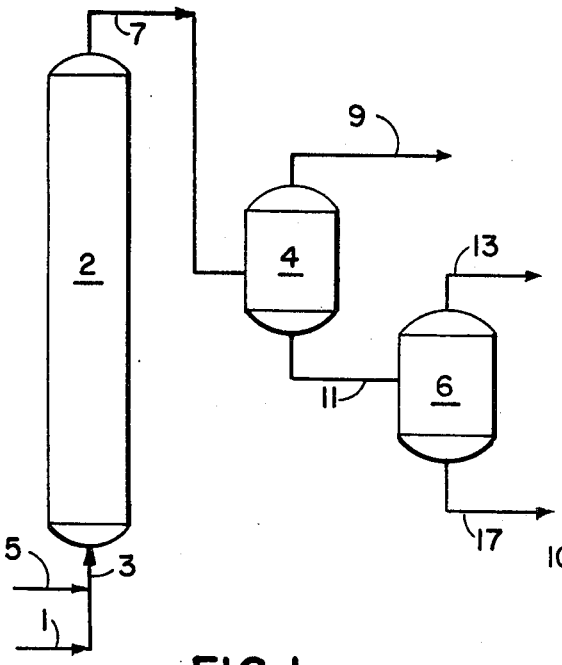
FIG. 1 is a diagrammatical representation of a process flow plan for the mild hydrogenation of asphaltene containing residual oil and subsequent treatment thereof through atmospheric distillation.

As shown in FIG. 1, an asphaltene containing residual oil is fed at 1 with hydrogen at 5 in upflow through 3 to the ebullated bed reaction zone 2. Reaction zone 2 can be a single reactor or a series of reactors.

Reaction zone 2 is operated under mild hydrogenation conditions of temperatures between 700°F and 800°F but preferably 720°F to 780°F, hydrogen partial pressures between 1200 and 3000 psig but preferably 1500 and 2400 psig, and liquid space velocities between 0.1 and 2.0 $V_f/hr/V_r$ but preferably 0.3 and 1 $V_f/hr/V_r$.

An effluent leaves reaction zone 2 in line 7 and passes to an atmospheric distillation zone 4. The fraction boiling below 650°F leaves zone 4 in line 9. The material boiling above 650°F leaves zone 4 in line 11. This bottoms fraction passes in line 11 to desulfurization zone 6. A high yield of low sulfur fuel oil is obtained and leaves the reaction zone through line 17 with an overhead product leaving in line 13.

Figure 2:
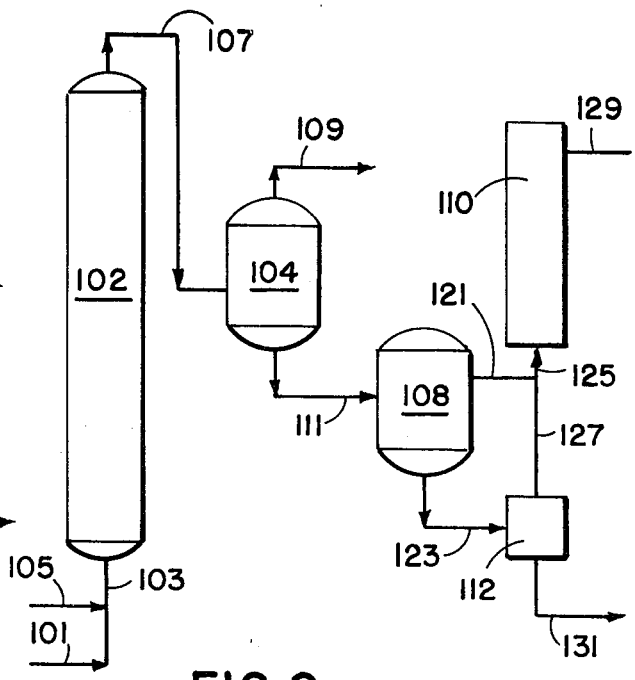
FIG. 2 is a diagrammatical representation of a process flow plan for the mild hydrogenation of asphaltene containing residual oil and subsequent treatment thereof through deep vacuum distillation.

As shown in FIG. 2, an asphaltene containing residual oil is fed at 101 with hydrogen at 105 in upflow through 103 to the ebullated bed reaction zone 102. Reaction zone 102 can be a single reactor or a series of reactors.

Reaction zone 102 is operated under mild hydrogenation conditions of temperatures between 700°F to 800°F but preferably 720°F to 780°F, hydrogen partial pressures between 1200 and 3000 psig but preferably 1500 and 2400 psig, and liquid space velocities between 0.1 and 2.0 $V_f/hr/V_r$, but preferably between 0.3 and 1.0 $V_f/hr/V_r$.

An effluent leaves reaction zone 102 in line 107 and passes to an atmospheric distillation zone 104. The fraction boiling below 650°F leaves zone 104 in line 109. The material boiling above 650°F leaves zone 104 in line 111. This bottoms fraction passes in line 111 to deep vacuum distillation zone 108. The 650° to 1150°F boiling fraction leaves zone 108 in line 121 and enters zone 110 via line 125. Zone 110 may be a desulfurization or hydrocracking zone. If zone 110 is operated as a desulfurization zone, the effluent in line 129 consists of a heavy gas oil with a very low sulfur content. This gas oil at 129 could be blended back with the vacuum resid in line 123 to produce a low sulfur fuel oil. Alternately the vacuum still 108 may be operated to produce products at a 975°F cut point. Then the bottoms fraction from zone 108 passes by line 123, and enters deasphalter 112. The deasphalted gas oil leaves zone 112 in line 127 to then enter zone 110 operated as a desulfurizer or hydrocracker. The asphalt material leaves zone 112 in line 131.

The effluent in line 129 is suitable as a heavy gas oil having characteristics of a very low sulfur content. For a low sulfur fuel oil, the heavy gas oil can be blended back with the asphalt in line 131 which has been reduced in quantity compared to the feed. If zone 110 is operated as a hydrocracking zone, the effluent in 129 is separated into fuel oil blendstock and light hydrocarbons, depending upon the extent of hydrocracking.

By subjecting high asphaltene containing residual petroleum oils to a mild hydrogenation pretreatment prior to desulfurization, a distinct shift in the boiling range of the material occurs whereby more distillable materials and less non-distillable materials are obtained.

Having thus described the preferred embodiments of this invention, reference is now had to specific examples which have been carried out in accordance with the process of the present invention.

EXAMPLE 1

A heavy Venezuelan atmospheric residuum is processed under mild hydrogenation conditions for maximum conversion of asphaltenes. A cobalt molybdate catalyst having a bulk density of 35 lbs/cu.ft. is used. A maximum asphaltene conversion of 32 wt. percent is obtained at a conversion of about 18 percent of the material in the feed boiling above 975°F. For some of the experiments the residuum is diluted with decant oil as indicated in Table 1. It is felt that this diluent has no effect on the relationship between the asphaltene conversion and the 975°F+ conversion. Typical operating conditions including a hydrogen pressure of 2000 psig result in conversions as shown on curve 30 of FIG. 3.

Figure 3:
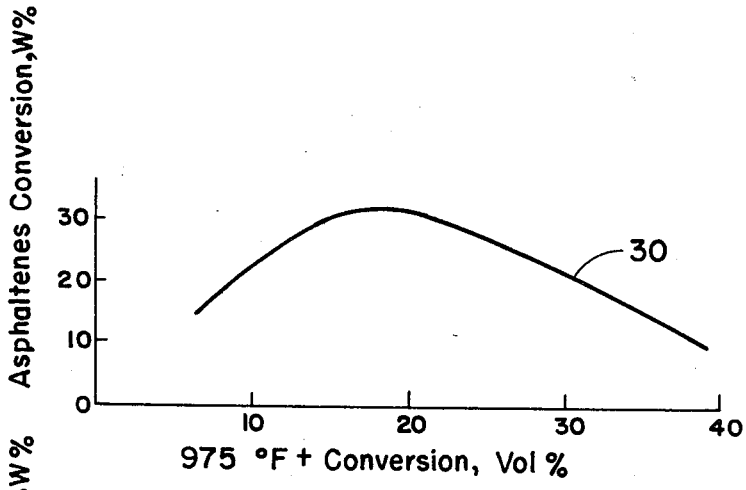
FIG. 3 is a graph of the maximum asphaltene conversion as a result of the conversion of the 975°F+ material in a heavy Venezuelan atmospheric residuum feed under mild hydrogenation conditions.

FIG. 3 shows data for the maximum conversion of the asphaltenes in a Venezuelan atmospheric residuum wherein the hydrogen partial pressure is 2000 psig while the space velocity varies between 0.25 $V_f/hr/V_r$ and 0.5 $V_f/hr/V_r$ and the temperature varies between 700°F and 780°F.

EXAMPLE 2

West Texas Vacuum Bottoms are processed under mild hydrogenation conditions in the presence of a cobalt molybdate on alumina catalyst having a bulk density of 45 lbs/cu.ft. A maximum asphaltene conversion of 60 wt. percent is obtained at a conversion of about 28 vol. percent of the 975°F+ material in the feed. Typical operating conditions including a hydrogen partial pressure of 2250 psig result in conversions as shown on curve 40 of FIG. 4.

Figure 4:
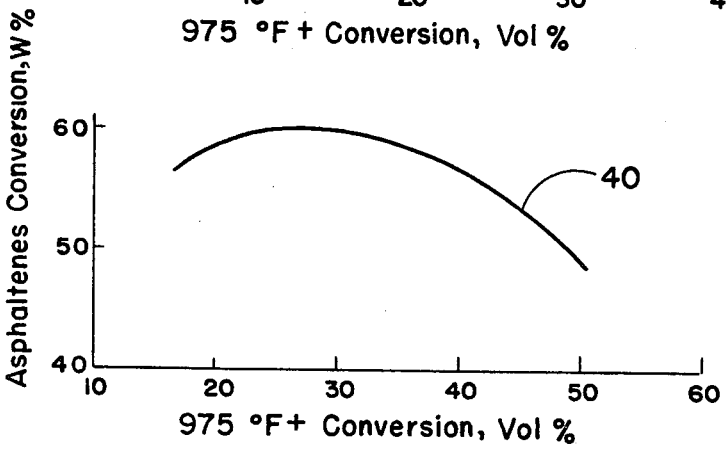
FIG. 4 is a graph of the maximum asphaltene conversion as a result of the conversion of the 975°F+ material in a West Texas vacuum residuum feed under mild hydrogenation conditions.

FIG. 4 shows data for the maximum conversion of the asphaltenes in a West Texas Vacuum Residuum wherein the hydrogen partial pressure is 2250 psig while the space velocity varies between 0.5 $V_f/hr/V_r$ and 1.0 $V_f/hr/V_r$ and the temperature varies between 750°F and 810°F.

Table 1 sets forth the inspections made on the residuum feeds used in Examples 1 through 10.

TABLE I

| | Heavy Venezuelan Atmospheric Residuum | 80% Heavy Venezuelan Atmospheric Residuum with 20% Decant oil | West Texas Vacuum Residuum |
|---|---|---|---|
| Gravity, °API | 12.1 | 8.6 | 9.2 |
| Sulfur, W% | 2.62 | 2.35 | 3.51 |
| Vanadium, ppm | 400.0 | 313.0 | — |
| Nickel, ppm | 65.0 | 52.0 | — |
| Asphaltenes, W% | 10.6 | 8.3 | — |
| IBP-975°F Fraction | | | |
| Volume, % | 45.0 | — | 5.0 |
| Gravity, °API | 19.2 | — | 16.9 |
| Sulfur, W% | 1.85 | — | 2.69 |
| 975°F+ Fraction | | | |
| Volume, % | 55.0 | — | 95.0 |
| Gravity, °API | 5.6 | — | 9.5 |
| Sulfur, W% | 3.68 | — | 3.54 |
| RCR, W% | — | — | 18.8 |
| Asphaltenes, W% | 18.5 | — | 12.2 |

TABLE I-continued

| | Heavy Venezuelan Atmospheric Residuum | 80% Heavy Venezuelan Atmospheric Residuum with 20% Decant oil | West Texas Vacuum Residuum |
|---|---|---|---|
| % S in Asphaltenes | 4.66 | — | 6.12 |
| 975–1115°F Fraction | | | |
| Volume, % | — | — | 41.8 |
| Gravity, °API | — | — | 13.8 |
| Sulfur, W% | — | — | 2.81 |
| RCR, W% | — | — | 6.0 |
| Vanadium, ppm | — | — | 10.0 |
| Nickel, ppm | — | — | 6.0 |
| 1115°F+ Fraction | | | |
| Volume, % | — | — | 53.2 |
| Gravity, °API | — | — | 3.5 |
| Sulfur, W% | — | — | 3.99 |
| RCR, W% | — | — | 27.8 |
| Vanadium, ppm | — | — | 85.0 |
| Nickel, ppm | — | — | 59.0 |

It was discovered, as shown in Examples 1 and 2, that a maximum of asphaltene conversion occurs at between about 5 and 45 volume percent conversion of the material boiling above 975°F in the feed. It was additionally discovered that there was a shift in the boiling range of the residuum being handled in that there was an increase in the distillable material. This was demonstrated by the high yield of the gas oil boiling in the 975° to 1150°F range. The quality of this gas oil was much higher than the quality of the gas oil in the feed and also higher than that obtained while operating at more severe hydrogenation conditions. This can be seen from Table 2 wherein inspections are shown for unconverted West Texas Vacuum residuum feed, products from the mild hydrogenation of this residuum at maximum asphaltene conversion and products from the severe hydrogenation of this residuum. The comparison can be made by observing the differences in API gravity, Ramsbottom Carbon residue (RCR), and vanadium and nickel content. It can also be seen that with the mild hydrogenation pretreatment, the residuum had the unexpected property of being distillable to a higher temperature without undergoing thermal cracking, as noted by the cut points shown in Table 2. In other words, a greater portion of the product gas oil could be removed by distillation from the total product since it could be subjected to higher temperatures in a vacuum still without degradation.

As atmospheric distillation can satisfactorily handle overheads with an upper boiling point of only up to about 800°F, deep vacuum distillation is required to recover useable fractions boiling up to 1200°F. We found that the recovery of these higher boiling fractions is complicated by the asphaltenes present in the higher boiling fractions. These asphaltenes may boil above 1200°F and so the deep vacuum distillation has heretofore yielded only a small additional amount of useable product or the material in the unit has undergone excessive degradation or coking. We have discovered that a maximum portion of these troublesome asphaltenes could be converted from non-distillable fractions to distillable fractions under deep vacuum distillation through the use of a mild hydrogenation step, and thus, provides a process by which greater useable fractions can be recovered from residual oils. This is further demonstrated by the following Examples 3 through 10.

TABLE 2

| | West Texas Vacuum Residuum Feed | Mild Hydrogenation Pretreatment | Severe Hydrogenation |
|---|---|---|---|
| % 975+ Conversion | 0 | 28.1 | 58.3 |
| Cut Point, °F | 975–1115 | 975–1152 | 975–1155 |
| Yield, Vol.%(FF) | 41.8 | 45.9 | 28.6 |
| Gravity, °API | 13.8 | 20.0 | 18.6 |
| Sulfur, W% | 2.81 | 0.4 | 0.32 |
| RCR, W% | 6.0 | 3.1 | 5.6 |
| Vanadium, ppm | 10.0 | 2.9 | 10.0 |
| Nickel, ppm | 6.0 | 4.8 | 10.0 |
| Cut Point, °F | 1115+ | 1152+ | 1155+ |
| Yield, Vol.%(FF) | 53.2 | 22.4 | 11.0 |
| Gravity, °API | 3.5 | 8.9 | 5.3 |
| Sulfur, W% | 3.99 | 1.38 | 1.54 |
| RCR, W% | 27.8 | 23.7 | 29.4 |
| Vanadium, ppm | 85.0 | 58.0 | 53.0 |
| Nickel, ppm | 59.0 | 44.0 | 49.0 |
| 975°F+ Fraction | | | |
| Gravity, °API | 9.5 | 16.0 | 15.1 |
| Sulfur, W% | 3.54 | 0.73 | 0.68 |
| RCR, W% | 16.3 | 10.2 | 12.0 |
| Vanadium, ppm | 51.0 | 18.0 | 21.0 |
| Nickel, ppm | 33.0 | 16.0 | 21.0 |
| Asphaltenes,W% | 12.2 | 7.12 | 9.36 |

EXAMPLE 3

The 650°F+ fraction distilled from the total product obtained at the conditions indicated in Example 2, above, has an API gravity of 17.7 and a sulfur content of 1.06 wt.%. It is desulfurized at 2000 psig hydrogen partial pressure, 750°F and 1.2 $V_f/hr/V_r$ space velocity with a cobalt molybdate on alumina catalyst to yield a product of 0.32 Wt.% S. The yield of 650°F+ fuel oil is 92 vol. % based on feed to the mild hydrogenation step.

EXAMPLE 4

The product from Example 2 is distilled in atmospheric and vacuum towers to produce a 975°F+ fraction and various fractions boiling below 975°F. The 975°F+ fraction undergoes propane deasphalting. A deasphalted gas oil product is obtained having a 18.3°API and 1.1 wt/% sulfur. It is then desulfurized with a nickel molybdate on alumina catalyst at 2000 psig hydrogen partial pressure, 750°F and 2.0 $V_f/hr/V_r$. The desulfurized deasphalted gas oil has a sulfur content of 0.18 wt.%.

EXAMPLE 5

The product from Example 2 is distilled in an atmospheric tower and then in a vacuum tower to separate out a 650°–1150°F boiling range gas oil. The improved stability of the product produced in the mild hydrogenation step allows the distillation to be accomplished without thermal gradation of the distillation products. The gas oil has an API gravity of 20.8 and a sulfur content of 0.57 wt.%. It is desulfurized at 1500 psig hydrogen partial pressure, 750°F and 3.3 $V_f/hr/V_r$ to a level of 0.1 wt.% sulfur with a cobalt molybdate on alumina catalyst.

EXAMPLE 6

The initial 975°F– product from Example 2 is blended with the desulfurized deasphalted gas oil and the asphalt to produce a product with 0.52 wt.% sulfur (weighted average) as indicated below.

| Fraction | Yield, Volume % | Sulfur Content, Wt.% |
|---|---|---|
| IBP-650°F | 12.2 | 0.10 |
| 650–975°F | 23.2 | 0.25 |
| Deasphalted gas oil | 59.0 | 0.18 |
| Asphalt | 10.4 | 3.1 |
| | 104.8 | 0.52 |

EXAMPLE 7

The initial 650°F– product is blended with the desulfurized 650°–1150°F vacuum still overhead and the vacuum bottoms to produce a product with a sulfur content of 0.70 weight percent (weighted average) as indicated below.

| Fraction | Yield, Volume % | Sulfur Content, Wt. % |
|---|---|---|
| IBP-650°F | 12.2 | 0.1 |
| 650–1150°F | 70.8 | 0.1 |
| 1150°F+ | 22.4 | 2.5 |
| | 105.4 | 0.70 |

EXAMPLE 8

The asphalt remaining from Example 4 is coked in a delayed coker and the coker gas oil obtained is desulfurized. The yield based on the West Texas Vacuum Bottoms originally used in Example 2 is 2.5 vol.% and it has a sulfur content of 2.45 wt.%. This material is desulfurized over cobalt molybdate catalyst at 1500 psig hydrogen partial pressure, 1.0 $V_f/hr/V_r$ and 760°F. The desulfurized coker gas oil is then blended with the desulfurized gas oil to produce a fuel oil product containing 0.18 wt. % sulfur as indicated below.

| Fraction | Yield, Volume% | Sulfur Content, Wt.%S |
|---|---|---|
| Desulfurized Coker Gas Oil | 2.5 | 0.18 |
| Desulfurized D.A.G.O. | 59.0 | 0.18 |
| Total | 61.5 | 0.18 |

EXAMPLE 9

The 1150°F+ vacuum bottoms product from Example 5 is coked. The coker gas oil obtained has an API gravity of 16 and 1.98 wt.% S. The yield is 4.5 vol. % based on the feed for Example 2. It is desulfurized with a cobalt molybdate catalyst at 1500 psig hydrogen partial pressure, 750°F and 1.0 $V_f/hr/V_r$ to a level of 0.18 wt. % sulfur. It is then blended with the desulfurized gas oil to produce a low sulfur fuel oil product having 0.12 wt. % sulfur (weighted average) as indicated below.

| Fraction | Yield, Volume % | Sulfur Content, Wt.%S |
|---|---|---|
| Desulfurized Coker Gas Oil | 4.7 | 0.18 |
| Desulfurized Heavy Gas Oil | 70.8 | 0.10 |
| Total | 75.5 | 0.12 |

EXAMPLE 10

The 650°–1150°F gas oil produced in Example 2 represents 69.1 volume percent of the feed for that example and has an API gravity of 20.8 and a sulfur content of 0.57 wt. %. It is hydrocracked over a nickel tungsten sulfide on silica-alumina hydrocracking catalyst at 1500 psig hydrogen partial pressure, 770°F and 0.5 $V_f/hr/V_r$. The yield structure based on the feed to Example 2 is indicated below.

| Product Fractions | Yields |
|---|---|
| $H_2S$, $NH_3$ | 3.9 W% |
| $C_1$-$C_3$ Light Gas | 4.0 W% |
| $C_4$-650°F | 86.5 V% |
| 650–1150°F | 0.0 V% |
| 1150°F+ | 22.4 V% |

As shown by the examples, this gas oil is of a quality that is high enough so that it can be fed to catalytic cracking units or hydrocracking units for gasoline production. Furthermore, it would be a superior stock for desulfurization while the product gas oil from the desulfurization step could be blended back with the 1150°F plus vacuum bottoms to yield a low sulfur fuel oil.

As can be determined from the hereinabove description of this invention and the examples thereof, many modifications and alterations of the above hydrogenation invention will become apparent to those skilled in the art. However, the scope of this invention should not be unduly restricted thereby, and is limited only by the claims appended hereto.

We claim:

1. A continuous catalytic process for the removal from residual petroleum oils of the pentene insoluble asphaltene fraction prior to hydrodesulfurization which comprises:

a. feeding said residual oil with hydrogen upwardly through an ebullated bed reaction zone containing a particulate hydrogenation-type catalyst.

b. maintaining said reaction zone at a temperature between about 700° and 800°F, liquid space velocity between about 0.1 and 2.0 $V_f/hr/V_r$ and hydrogen partial pressure of between about 1200 and 3000 psi;

c. converting between about 5 and 45 percent of the material in said residual oil boiling above 975°F to material boiling below 975°F to achieve at least a 20 weight percent conversion of said asphaltenes;

d. passing the effluent to an atmospheric distillation zone;

e. removing a vaporous overhead with an upper boiling point of less than about 800°F and a liquid bottom containing minimum pentane insoluble asphaltenes.

2. The process of claim 1 wherein said residual oil is Heavy Venezuelan Atmospheric Residuum and wherein about 14 to 22 percent of the material in said oil boiling above 975°F is converted to material boiling below 975°F and more then 20 weight percent conversion of the asphaltenes.

3. The process of claim 1 wherein said residual oil is West Texas Vacuum Bottoms and wherein about 20 to 35 volume percent of the material in said oil boiling above 975°F is converted to material boiling below 975°F and more than 55 weight percent conversion of the asphaltenes.

4. The process of claim 1 wherein said liquid bottoms are desulfurized to produce a low sulfur overhead and a low sulfur bottoms.

5. The process of claim 1 wherein said reaction zone is maintained at a temperature between about 720°F and 780°F with a liquid space velocity therethrough between about 0.3 and 1.0 $V_f/hr/V_r$ and under a hydrogen partial pressure between about 1500 and 2400 psi.

* * * * *